US005083714A

United States Patent [19]

Vendelin et al.

[11] Patent Number: 5,083,714

[45] Date of Patent: Jan. 28, 1992

[54] VERTICAL SHAFT IMPACT CRUSHER HAVING A VERTICALLY ADJUSTABLE FEED TUBE

[75] Inventors: John C. Vendelin; Frederick J. Winegar, both of Springfield, Oreg.

[73] Assignee: Cedarapids, Inc., Cedar Rapids, Iowa

[21] Appl. No.: 693,138

[22] Filed: Apr. 29, 1991

[51] Int. Cl.[5] ..... B02C 19/00

[52] U.S. Cl. ..... 241/275; 241/285 A

[58] Field of Search ..... 241/285 A, 275; 222/353, 457; 403/348, 349

[56] References Cited

U.S. PATENT DOCUMENTS

| | | | |
|---|---|---|---|
| 1,033,187 | 7/1912 | Metzger | 403/349 |
| 2,919,864 | 1/1960 | Parmele . | |
| 4,513,919 | 4/1985 | Terrenzio | 241/275 |
| 4,575,014 | 3/1986 | Szalanski et al. | 241/275 |
| 4,699,326 | 10/1987 | Warren | 241/275 |

FOREIGN PATENT DOCUMENTS

| | | | |
|---|---|---|---|
| 0763618 | 9/1980 | U.S.S.R. | 403/348 |
| 1467019 | 3/1989 | U.S.S.R. | 222/457 |

*Primary Examiner*—Frank T. Yost
*Assistant Examiner*—John M. Husar
*Attorney, Agent, or Firm*—Simmons, Perrine, Albright & Ellwood

[57] ABSTRACT

A vertical shaft impact crusher has an vertically adjustable feed tube disposed within a throat between a feed hopper of the crusher and the crusher lid of the housing. The feed tube may be adjusted in predetermined discrete increments to within a predetermined distance above an impeller table of the crusher within the housing of the crusher and without removing the hopper of the crusher during such adjustment. The adjustment is achieved by rotating an adjustment ring disposed at an interface between a hopper portion and a lid portion of the throat between the hopper and the lid. The adjustment ring may be held between to adjacent throat flanges to rotate circumferentially about a vertical crusher axis. The feed tube is a two-piece tube which includes an upper, re-usable portion and a lower expendable portion. The feed tube is held within a carrier tube which includes circumferentially spaced adjustment steps. The adjustment ring includes radially inward extending lugs which engage respective steps to support the feed tube at a height determined by the vertical position of the respective steps with respect to the carrier tube. As the ring is rotated in one predetermined direction, the lugs move off one set of steps and the tube drops until the lugs engage an adjacent set of steps of the carrier tube. A circumferential movement of the adjusting ring in the direction opposite to the adjustment rotation of the ring cuases the lugs to engage an undercut disposed at an inner end of each adjustment step.

13 Claims, 4 Drawing Sheets

FIG. 5
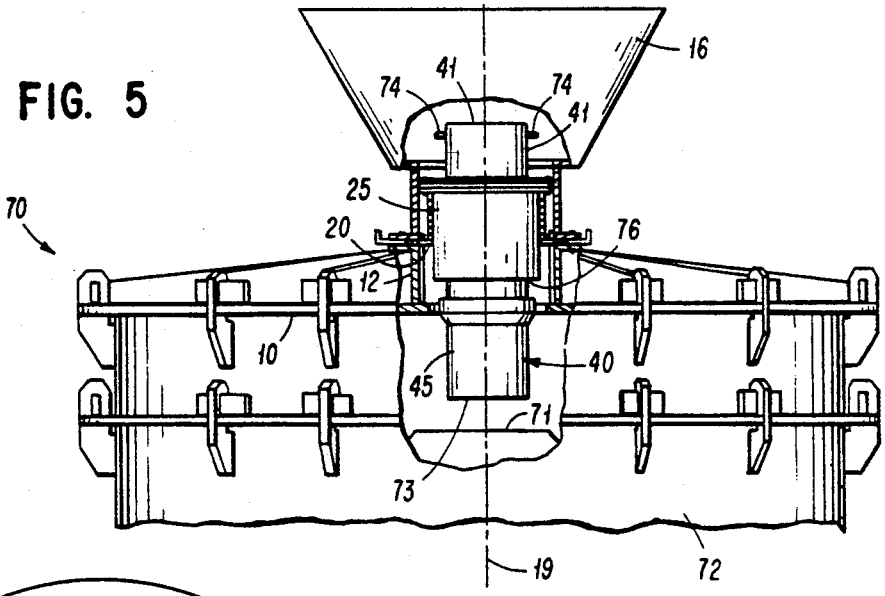
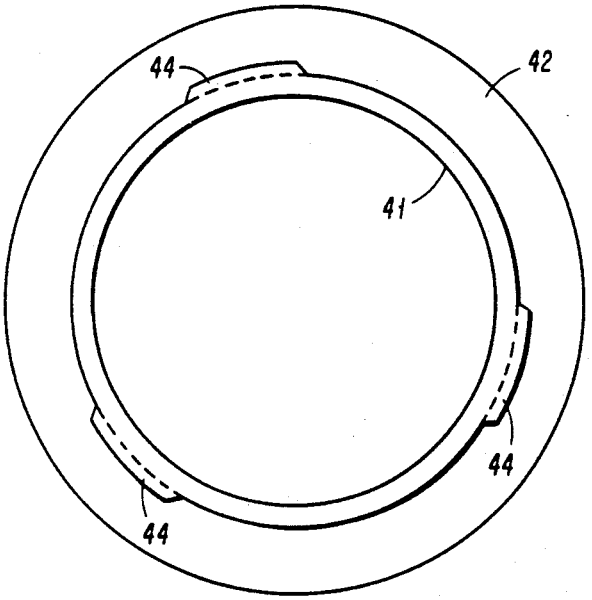
FIG. 6
FIG. 7
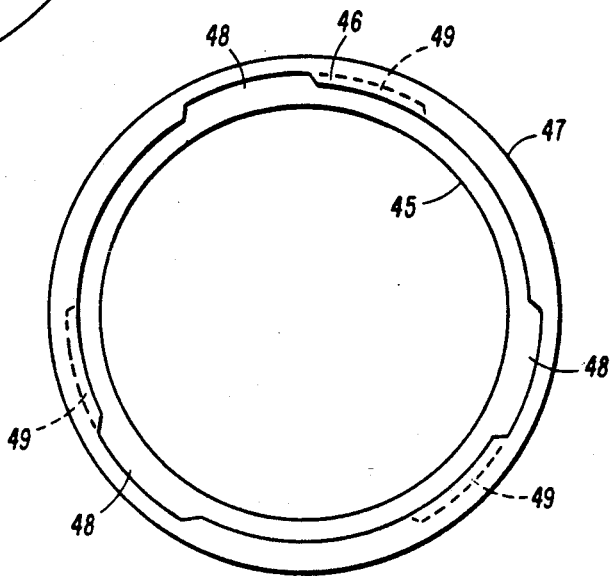

VERTICAL SHAFT IMPACT CRUSHER HAVING A VERTICALLY ADJUSTABLE FEED TUBE

BACKGROUND OF THE INVENTION

1. Field of the Invention

The invention relates generally to vertical impact crushers for crushing brittle and typically abrasive materials such as rocks and the like, and more particularly to vertical shaft impact crushers which include vertically adjustable feed tubes.

2. Discussion of the Prior Art

A typical vertical shaft impact crusher employs an impeller rotor or table at the upper end of a vertical, driven shaft. The rotor revolves in a housing into which material to be crushed is supplied from a feed hopper through a generally vertical "feed tube". The feed tube extends from the feed hopper downward through a lid of the crusher and has an opening at its lower end adjacent the table of the crusher. The lower end of the feed tube is subject to relatively rapid wear from the swirling material as it strikes the feed cone or the like about the center of the table. Consequently, the feed tube must be periodically lowered in order to maintain a proper relationship to the crusher's table. Traditionally that adjustment has been effected by spacer blocks between a flange at the upper end of the feed tube and a flange in the feed hopper. After the feed tube is worn beyond an acceptable limit, the tube is pulled up out of the hopper, the built-up material between the tube, spacers and hopper is cleaned out, one or more of the spacer blocks is removed, and the feed tube reinstalled, all steps constituting a laborious and time-consuming job.

Without the feed tube or with improper vertical adjustment of the feed tube to an optimum spacing between a top table surface of the impeller rotor and the lowermost end of the feed tube, the crusher fails to operate properly. In accordance with the prior art practices a spare feed tube may be mounted back to back to an operationally adjusted feed tube extending to just above the rotor or impeller table. The spare feed tube typically extends into the crusher feed hopper to support a peripheral thickness of rock materials and reduce wear of hopper walls. When the active feed tube is worn beyond acceptable limits, the spare feed tube may be substituted for the active feed tube to restart the adjustment process described above.

Another approach is shown in U.S. Pat. No. 4,513,919 to Terrenzio in which a rather elongated feed tube is slidably disposed within the feed hopper which is mounted on brackets attached to the crusher lid. The tube is encircled below the hopper by a releasable clamp, the clamp in turn being separately supported from the crusher lid on upright threaded studs having pairs of nuts between which the clamp is captured. The clamping hold on the feed tube may be released for an up and down adjustment of the feed tube. It is understood that in typical impact crushers, a feed tube is of a substantial weight, the weight making the vertical adjustment of the feed tube a rather complex procedure. When the feed tube is worn beyond acceptable limits, the entire tube, since it is one piece, needs to be replaced by releasing the clamp and lifting the tube out through the hopper. As with other known adjustable feed tubes, the last described adjustment provision does not address a problem of the remaining upper half of the feed tube when the lower portion has worn and feed tube has been adjusted to its lowermost position. Thus the upper portion of the feed tube is typically considered a wasted remainder. Also, because of dust and fines which are present during the crushing operation, bolt threads are likely to become damaged or begrimed making the threaded fasteners, such as for clamping the feed tube, difficult to turn. In view of the above described continuing difficulties in making adjustments to feed tubes of the described crushers, it is an object of the present invention to provide an adjustable feed tube for a vertical shaft impact crusher which alleviates above referred to disadvantages and which further improves the state of the art by facilitating the adjustment of the feed tubes of vertical shaft impact crushers and by allowing the feed tubes to be adjusted in a predictable manner from the outside of the crushers. Another object of the invention is to provide a feed tube of which an unused remainder of the feed tube after final adjustment of the feed tube is minimized.

SUMMARY OF THE INVENTION

In accordance with the invention, a vertical shaft impact crusher comprises an adjustable feed tube assembly which comprises a provision for incrementally adjusting a feed tube downward to a predetermined vertical position above an impeller table.

According to a more particular aspect of the invention, an expendable lower feed tube portion is attached to a re-usable upper feed tube portion which is partially protected from wear. As the lower feed tube portion wears to less than an acceptable axial length for a desirable maximum spacing between an impeller or rotor table and the lowermost end of the feed tube to be obtained, the expendable lower end is replaced by another expendable lower feed tube portion while the upper feed tube portion may be re-used.

Advantages of the invention include an ability to adjust the feed tube by known amounts from outside of the crusher, even though the feed tube is disposed within the throat between the hopper and the crusher and is externally not visible.

Another advantage relates to an ability to lock or secure the position of the feed tube after adjustment in a simple and efficient manner, such that risk of an upward movement of the feed tube because of material build-up in the crusher is substantially eliminated.

A further advantage relates to the minimization of non-usable waste in a feed tube that is left over when the feed tube of the crusher reaches the end of an adjustment range and needs to be replaced. The latter advantage is seen in a two-piece feed tube in which an upper tube or upper tube portion is a re-usable portion.

Correspondingly, a lower piece or tube portion of the two-piece feed tube is intended to be a replaceable feed tube, hence, a wear item, in that the feed tube typically wears from the bottom upward toward the top. As the lowermost end of the feed tube wears, the feed tube is adjusted downward in accordance with the invention, until the lower tube is substantially worn, except for a remainder adjacent an upper rim of the tube. The upper rim includes provisions for attaching the lower tube to the upper tube, which provisions according to a particular embodiment also protect the lowermost end of the upper tube from wear, as the two-piece feed tube is repeatedly adjusted downward over a life cycle of the lower tube portion.

The aforementioned advantage of optimizing use of available wear length of the tube and minimizing percentage-wise wasted tube material during a replacement of the worn portion of the tube is realized by the two-piece structure. Of the two-piece feed tube only the lower portion of the tube, rather than the entire tube, need be replaced on account of wear. The upper portion of the feed tube which might otherwise be discarded may be re-used.

Other features and advantages of the invention will become apparent from the reading of the Detailed Description below in reference to the appended drawings.

BRIEF DESCRIPTION OF THE DRAWINGS

The Detailed Description including the description of a preferred structure as embodying features of the invention will be best understood when read in reference to the accompanying drawings wherein:

FIG. 5 is a partial, somewhat simplified and partially sectioned side elevation of a vertical shaft impact crusher to illustrate the disposition of the adjustable feed tube assembly of FIG. 1 relative to the crusher;

FIG. 6 is a bottom plan view of an upper half of the feed tube to illustrate a particular feature of the adjustable feed tube; and FIG. 7 is a top plan view of a corresponding lower half of the feed tube to illustrate a temporary attachment of the replaceable lower half of the feed tube to the reusable upper half of the feed tube, and

DETAILED DESCRIPTION OF THE INVENTION

Figure 1:
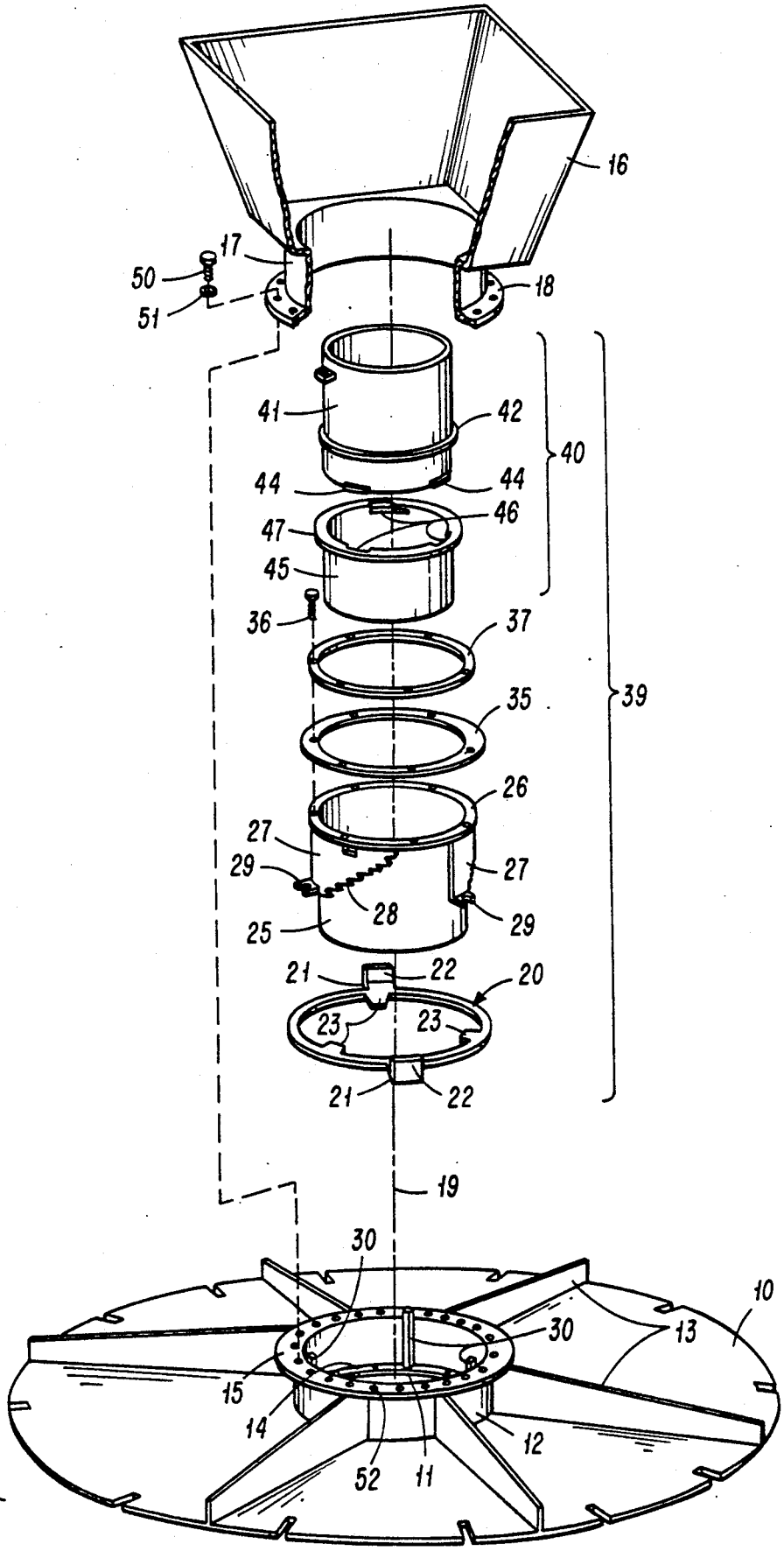
FIG. 1 shows an exploded view of the adjustable, two-piece feed tube assembly of a vertical shaft impact crusher according to the invention with respect of a lid of the housing of the crusher.

The invention may be best understood when major elements of an adjustable feed tube assembly are introduced and described. In the exploded view of FIG. 1 there is shown as a base or mounting member, a vertical shaft impact crusher lid 10. The lid 10 has a central opening 11. The opening 11 is surrounded by a cylindrical lid throat 12. Typical stiffening ribs 13 extend radially outward from the lid throat 12 and rigidize the lid in a known manner to better resist the pounding of impelled and crushed flying rocks against its inner surface. Preferably the inner diameter of the lid throat 12 may be larger than the diameter of the central opening 11, such that a narrow inner ledge 14 remains about the opening 11 inside of the lid throat 12. The throat 12 in turn is topped by a radially outward flange 15 for mounting a feed hopper 16. The hopper 16, which may be of any suitable shape, is preferably equipped with a cylindrical throat 17 of the same diameter as the lid throat 12. The cylindrical throat 17 of the hopper 16 is further provided with a bottom flange 18 with typical, matched holes in both the flange 15 and the flange 18 for bolting the hopper 16 to the lid flange 15. The central opening 11, the lid throat 12 and the cylindrical throat 17 of the hopper 16 are all centered on and coaxially aligned with a central crusher axis 19.

An element for facilitating desired vertical adjustments in accordance herewith is preferably disposed between the flanges 15 and 18. In particular, an adjusting ring 20 would in the assembled state be disposed congruent with and between the two flanges 15 and 18. The ring 20 includes a pair of diametrically opposite outer tabs 21 with upturned ends 22. The tabs 21 extend from the outer periphery of the ring 20. Preferably three equally spaced adjusting lugs 23 extend radially inwardly from an inner edge of the ring 20. The circular body of the ring 20 itself is of a diameter which preferably is disposed within the boundary established by bolts for tightening the flanges 15 and 18. The adjusting ring 20 ma consequently be rotated about the central axis 19 while disposed between the two flanges 15 and 18 with the limitation that selected bolts extending through the flanges 15 and 18 may need to be removed to advance the tabs 21 past such bolt locations.

The ring 20 in turn supports the vertical position of a carrier and particularly a carrier tube 25 spacedly fitting within and concentric with the two throats 12 and 17 and the ring 20, such that the carrier tube 25 is also coaxially aligned with the central axis 19 of the crusher. The carrier or carrier tube 25 includes an upper flange 26, welded below which are a trio of arcuate plates 27 equally spaced about the cylindrical peripheral outer surface of the carrier tube 25. The plates 27 are provided with identical sets of undercut steps 28 in their corresponding side edges, which steps ascend upwardly from about the middle of the carrier tube 25 to the flange 26. The steps 28 are progressively engageable with the adjusting lugs 23 by rotation of the adjusting ring 20 relative to the carrier tube 25. Thus by rotating the adjusting ring 20 in the ascending direction of the steps 28, the carrier tube 25 may be progressively lowered within the throats 12 and 17. The steps 28 are in essence or provide a number of vertically achievable adjustment steps or adjustment levels 28 for the carrier tube 25. The lower ends of the plates 27 adjacent the lowermost steps 28 are further provided with three radially extending carrier tube locating forks 29. The forks 29 are guides which slidably engage a correspondingly spaced trio of parallel carrier tube locating keys 30 welded to the inner wall of the lid throat 12. The guides thereby restrain any rotation of the carrier tube 25 about the axis 19, guiding the carrier tube for vertical movement within the throats 12 and 17. The annular space between the hopper throat 17 and the carrier tube 25 is by preference sealed at its upper end by a seal 35 bolted with threaded fasteners 36 through a clamp ring 37 into the upper face of the carrier tube flange 26 so that the seal 35 wipes the inner surface of the hopper throat 17 as the carrier tube 25 is lowered incrementally to a selected one of all available incremental adjustment levels or steps 28 within the throats 12 and 17.

The adjustable feed tube assembly 39, in accordance herewith, includes a two-portion feed tube 40 which consists of upper and lower feed tube halves or portions. Accordingly, an upper tube half 41 is a sleeve cast of a hard alloy with a supporting flange 42 extending outwardly about its midsection, as is also shown in the sectional view of FIG. 2. The upper tube half 41 or simply upper tube 41 spacedly fits within the carrier tube 25. The supporting flange 42 has an outer diameter which fits slidingly within the inner cylindrical space of the carrier tube 25. When the upper tube 41 is inserted into the carrier tube 25, the flange 42 centers the upper tube 41 with respect to the carrier tube and hence with respect to the central axis 19 of the crusher. Adjacent the lower end on the inside of the carrier tube 25, there is disposed an inner locating flange 43 (shown in FIG. 2) of the carrier tube. The inner locating flange 43 engages and carries the upper tube 41. The flange 43, hence, stops the further insertion of the upper tube 41 into the carrier tube 25 and vertically locates the upper tube 41 with respect to the carrier tube 25. As is best seen in further reference to FIG. 2, the carrier tube 25 forms a vertical support for the assembled feed tube 40. The carrier tube 25 has an axial length which is less than the axial length of the upper tube 41, the upper tube 41 extending both at the top and bottom ends of the carrier tube 25 axially well beyond the carrier tube 25. The space existing between the outer perimeter of the upper tube 41 and the carrier tube 25 deliberately remains open toward the top of the carrier tube 25 to form an annular pocket between the two tubes.

In reference to FIGS. 1 and 6, the lower end of the tube 41 is provided with three circumferentially equally spaced, integral lugs 44 extending radially outward from the periphery of the tube 41. A lower tube half or simply lower tube 45 is, similarly to the upper tube 41, a sleeve cast of preferably wear resistent alloy. Further in reference to FIG. 7, the lower tube 45 features on the inside of its upper end three recesses 46 which may be cast into an upper rim or upper lip 47 of the lower tube 45. The upper rim or lip 47 is of increased cylindrical wall thickness with respect to the remainder of the cylindrical portion of the lower tube 45. The recesses 46 are equally spaced about the rim and correspond to the spacing of lugs 44. In a preferred embodiment the recesses serve to provide a quick engagement of the upper rim 47 of the lower tube 45 to the lower end of the upper tube 41. A twisting operation temporarily attaches the lower tube 45 to the upper tube 41.

To engage the two portions or parts 41 and 45 of the feed tube 40, the lugs 44 interlock the lower end of the upper tube 41 with the upper end of the lower tube 45. Thus, in accordance with such twist mount arrangement, the recesses 46 extend radially outward into the lip 47 from the interior of the tube 45 and peripherally for about twice the peripheral length of the lugs 44. In reference to FIG. 7, an insert portion 48 of each of the recesses 46 extends in its entire radial depth axially of the lower tube 45 through the axial end of the lip 47. The insert portions 48 of the recesses 46 consequently receive the lugs 44, seen also in FIGS. 2 and 6, when the upper and lower feed tube portions 41 and 45 are axially engaged. When the lower tube 45 is thereafter axially rotated or twisted with respect to the upper tube 41, the lugs 44 become captured behind the lip 47 of rotationally displaced, axially closed recess portions 49 of the recesses 46 to lock the tubes 41 and 45 together (see also FIG. 3). In that the upper tube 41 is the reusable portion, and the lower tube is the expendable portion of the feed tube 40, a significant protective function of the rim 47 should be pointed out. Though the vertical adjustment of the feed tube assembly 39 is chosen to allow a major portion of the expendable tube portion, namely the lower tube 45, to be used, the rim 47 of the lower feed tube 45 is expected to remain substantially in tact at the time when a worn one of the lower tubes 45 is replaced by a new lower tube 45 in accordance herewith. If a rim portion, such as the rim or lip 47 of the lower tube 45 were instead disposed at the lower end of the upper tube 41, such that the replaceable lower tube 45 would fit inside the lower end of the upper tube 41, after only a few reuses of the upper tube, the rim would have experienced an excessive amount of wear and would also be in need of replacement. Thus, in the preferred embodiment, the lower tube 45 includes the rim 47 as a provision for protecting the attachment provisions on the upper tube 41, namely the lugs 44, from wear, thereby extending the service life of the upper tube 41. Though some wear does occur on the rim 47, each time a worn lower feed tube 45 is replaced, the protecting rim 47 is also replaced, starting a new wear cycle.

Figure 2:
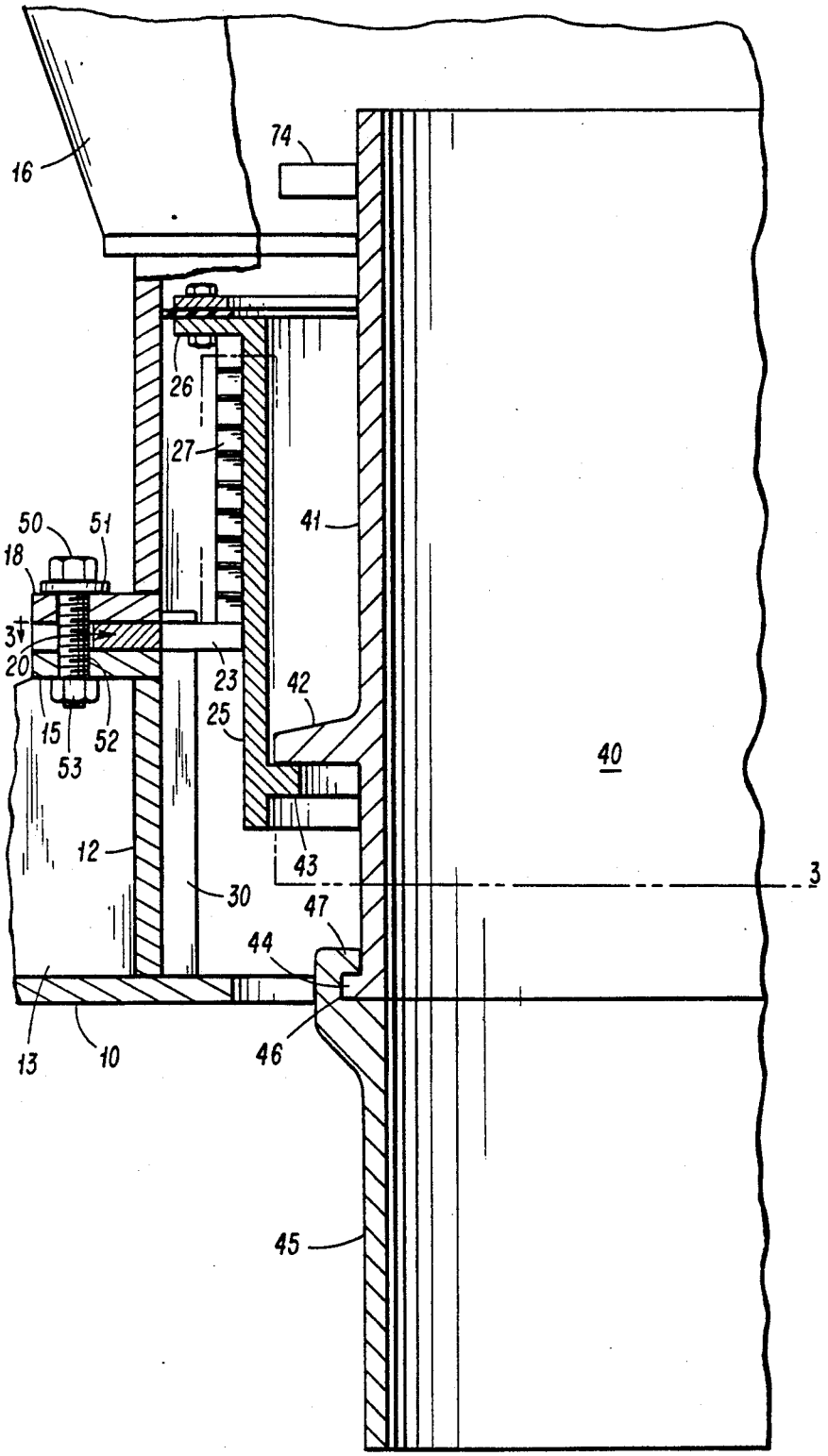
FIG. 2 is a partial, axial sectional view of the feed tube assembly taken along a line 2—2 in FIG. 3, the sectional view showing a portion of the adjustable feed tube assembly as an elevational section in an assembled state.
Figure 3:
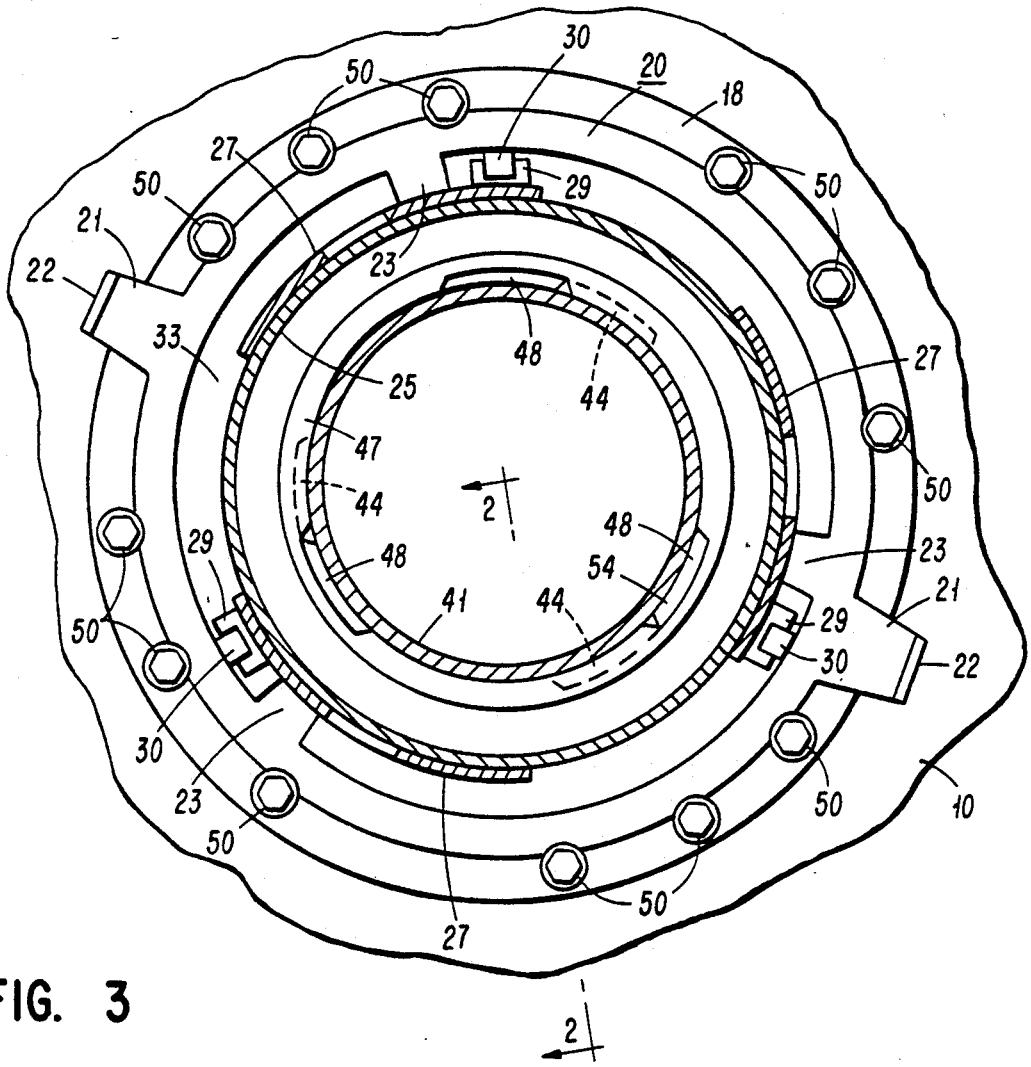
FIG. 3 is a cross-sectional view of the feed tube assembly taken along a line 3—3 in FIG. 2, showing a throat section of the adjustable feed tube assembly of FIGS. 1 and 2 in plan view.

In a preferred assembly mode of the described elements, in reference to FIGS. 1, 2 and 3, the hopper 16 may be initially removed from the lid 10. The carrier tube locating keys 30 are at that time welded inside the lid throat 12 to prepare for the installation of the adjustable feed tube assembly 39. In placing the locating keys 30, a template may be used to align the keys 30 parallel to the crusher vertical axis 19. The keys 30 may have a preferred length to extend from the ledge 14 of the lid 10 to a predetermined distance above the upper surface of the flange 15, such as by substantially the thickness of the adjusting ring 20.

The adjusting ring 20, by preference with the tab ends 22 pointing up, is then placed on the lid throat flange 15 with the lugs 23 just to one side of the keys 30 as shown in FIG. 3. If the keys 30 extend above the lid throat flange 15, the extending portions of the keys may also be used to center the adjusting ring 20 on the flange 15. In that position the carrier tube 25, when installed may readily be located at its uppermost position adjacent the first set of adjustment steps 28. The carrier tube 25 is preferably installed at this time with the dust seal 35 attached to the carrier tube flange 26 complete with the clamp ring 37 and bolts 36. The carrier tube 25 is lowered into place with the locating forks 29 engaging the keys 30. The installation of the carrier tube 25 prior to the installation of the hopper 16 provides ready access for the carrier tube 25 to be positioned in its uppermost position. The hopper 16 may then be positioned with the flange 18 onto the adjusting ring 20, and bolts 50 with appropriate washers 51 are inserted where possible through holes 52 in the hopper throat flange 18 and lid throat flange 15, the adjusting ring 20 being disposed within the inner opening of the circle defined by the bolts 50. Where needed for initial adjustment, selected ones of the bolts 50 may be omitted or removed to allow space for the initial positioning and counterclockwise movement of the outer tabs 21. It is to be noted that the designation counterclockwise denotes a counterclockwise direction about the central crusher axis 19 when the direction is rotationally viewed from above the crusher. The term clockwise, denotes correspondingly an opposite circumferential direction, also observed from above the crusher, looking down. The bolts 50 preferably extend through the lid throat flange 15 and are tightened with nuts 53 from below. Alternatively, the bolts 50 could be tightened into tapped holes in the lid throat flange 15. However, it has been found that internally threaded elements in structural elements such as the lid throat flange 15 tend to present problems, such as by dust accumulations in such internal threads. The angular spacing of the holes 52 on their respective bolt circle desirably enables the adjusting ring 20 to be rotated counterclockwise through at least some initial angle. In the further rotation of the adjusting ring 20 during successive adjustments of the feed tube 40, selected ones of the bolts 50 may be removed and others may in turn be replaced. In this manner an angle of rotation of the adjusting ring 20 of approximately fifty degrees is contemplated to accommodate the entire vertical adjustment range of the feed tube 40. Rotation of the adjusting ring 20 is readily accomplished with none of the bolts 50 fully tightened at the time of the adjustment.

The feed tubes 41 and 45, see also FIGS. 6 and 7, are locked together by engaging the lugs 44 of the former with the recesses 46 of the latter in the manner previously described and are retained by inserting a retainer bar 54 in at least one of the recess portions 48 (see FIG. 3). The feed tube 40 is then set in place in the carrier tube 25, the flange 42 of the upper tube 41 coming to rest on the inner carrier tube flange 43. To complete the installation and initial adjustment of the feed tube assembly 39, the adjusting ring 20 is then rotated counterclockwise, viewing the assembly 35 from above or from the hopper end of the assembly. The adjusting ring 20 will rotate when its tabs 21 are tapped with a hammer, for example. The adjusting ring is cautiously advanced in this manner until the adjusting lugs 23 position themselves on the first, that is, the lowermost, set of the steps 28 of the carrier tube 25. The positioning or seating of the carrier tube 25 occurs under the combined weight of the feed tube 40 and carrier tube 25 and is marked by a distinct drop of the carrier tube 25 into such first stepped adjustment position.

The initial drop of the carrier tube 25 to such first adjustment position establishes an initial adjusted height of the feed tube 40 but does not yet secure the feed tube with respect to the lid 10. Seating and securing the feed tube 40 in each adjustment step is accomplished by tapping the adjustment ring subsequently to the drop of the feed tube 40 in the opposite or clockwise direction to a full stop. The adjustment and seating of the feed tube 40 and carrier tube 25 is best explained with respect to FIG. 4, which shows schematically or as flat layout a preferred configuration of one of the arcuate plates 27 with the undercut adjustment steps 28. Each of the steps 28 is formed by a horizontal bearing surface 61 and an inwardly sloping retainer surface 62, the two surfaces being disposed at an acute angle "A" with respect to each other. In the preferred embodiment of the invention, the angle "A" may be 45 degrees, for example. The sloped disposition of the two surfaces 61 and 62 with respect to each other forms the undercut configuration at an inner edge of each of the steps 28, giving a sloping adjustment edge 63 of a number of adjacent ones of the steps 28 a saw-like appearance. It should be realized that the sloping retainer surface 62 forming the undercut in each step 28 is preferred, though other types of undercuts or angles other than the 45 degree angle may be used to achieve a beneficial result as described herein. Each cutout between two sawtooth type projections is formed by one of the adjustment steps 28. The slope of the adjustment edge 63 is defined by a vertical height or drop "D" between adjacent steps 28 and a pitch "P", which are in a preferred embodiment 0.5 inch and 0.875 inch respectively. A total of at least ten vertical adjustment steps is preferred. However, other linear distance values and a different number of discrete adjustment levels or steps 28 may be preferred depending on the type of material to be processed or on other factors, such as the size of the apparatus. In accordance with the preferred embodiment, adjacent ones of the steps 28 are circumferentially displaced as ascending toward the right, hence ascending in the counterclockwise direction about the central axis 19, as defined herein, namely as the carrier tube 25, hence the plate 27, is viewed from above the crusher.

Figure 4:
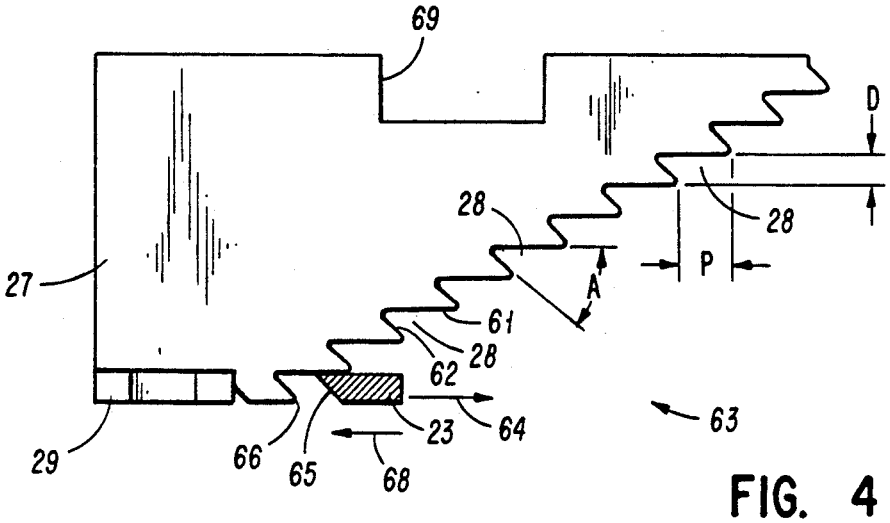
FIG. 4 is a schematic flat representation of structure which may be used to implement a preferred manner of stepwise adjusting a feed tube of an adjustable feed tube assembly in accordance with the present invention.

In further reference to FIG. 4, the adjusting lugs 23 have been advanced by the rotation of the adjustment ring 20 in the counterclockwise direction as indicated by arrow 64. The corresponding adjusting lug 23 (shown in FIG. 2) in relationship to the steps 28, shows a tapered seating portion 65, the taper of which matches the included angle between the surfaces 61 and 62 of the steps 28. The seating portion 65 is disposed at the trailing edge of the lug 23, relative to a counterclockwise movement of the lug 23. The drop of the feed tube carrier 25 occurs when the then trailing tapered portion 65 passes a foremost point 66 or the outer edge 66 of the current support surface or step 28 of the plate 27. After the drop of the carrier tube 25, as shown, the adjustment ring 20 is tapped to now rotate the ring clockwise, or opposite to the initial adjustment direction. Such rotation in the direction of arrow 68 secures or locks the carrier tube 25 against vertical movement to prevent any tilting or vertical movement of the carrier tube 25. Such movement may otherwise occur because of material impingement against the lower portion of the feed tube 40 during the operation of the described apparatus. After securing the carrier tube 25 in the described manner, the bolts 50 are fully tightened, preventing further rotational movement of the adjustment ring 20 between lid 10 and hopper 16. A cutout 69 in an upper part of the plate 27, shown in FIG. 4, simply provides clearance for a bolt 36 or corresponding nut to be tightened in attaching the upper seal 35. The lid throat flange 15 and the adjusting ring 20 may be marked for future reference to indicate the relative alignment of these two parts when in the starting position.

FIG. 5 is a somewhat simplified view of an upper portion of a vertical shaft impeller (VSI) crusher 70, showing the adjustable feed tube assembly 39 in relationship to such crusher 70. The lower end of the feed tube 40 is disposed at a preferred distance above an impeller surface or table of an impeller rotor 71. In accordance with well understood operating principles, the impeller rotor as depicted by the impeller table 71, disposed horizontally within a crusher housing 72 and centered on the central crusher axis 19, is rotatably driven in a horizontal plane, impelling materials to be crushed, such as rocks, radially outward against anvils or other impact surfaces (not visible) which are disposed circumferentially about the impeller table 71. The rocks or other materials wear away the lower end 73 of the feed tube 40. As the bottom end of the lower feed tube 45 wears away, the spacing between the lower end 73 and the impeller table 71 increases. The increase in the spacing also tends to increase the feed rate of the material which is radially impelled by the impeller table 71. An increase in the material feed rate appears to disproportionately increase the wear on various impact surfaces of the crusher 70. Consequently, the material feed rate is desirably controlled to control the wear and the crushing action of the crusher 70. The material flow or feed rate in controlled by adjusting the height of the lower end 73 of the feed tube 40 between controlled limits with respect to the table 71 for an optimum operation of the crusher 70. An optimum setting may be determined as a matter of choice and may vary somewhat with the type of material to be crushed.

The described adjustable feed tube assembly 39 has an advantage over other feed tubes by permitting the adjustment of the height of the lower end 73 of the feed tube 40 in the described incremental steps 28. Thus, the drop under the force of gravity of the carrier tube 25 and the feed tube 40 between one of the steps 28 and the next lower one permits the feed tube to be adjusted within the predetermined incremental distance defined by the drop between two successive steps or levels 28. The adjustment in reference to the crusher is controlled by the adjusting lugs on the adjusting ring 20 (see also FIG. 2). The height of the adjusting ring 20 above the table 71 is established by its fixed relationship to the housing 72. To implement the adjustment when from the operation of the crusher 70 an adjustment appears desirable, the bolts 50 can be loosened so that the adjusting ring 20 can be rotated counterclockwise by its tabs 21 to lower the feed tube 40 as may be required, and thereby maintain the preferred distance between the bottom end 73 of the lower feed tube 45 and the top of the impeller table 71. Each successive incremental downward adjustment of the feed tube 40 is substantially the same as any prior one. This is of advantage, in that under established operating conditions, intervals between successive adjustments are substantially equal. Furthermore, the predetermined increments of adjustment allow the adjustment to be carried out without tediously gauging the height of the lower end 73 or possible erring in the adjustment and thereby causing costly delay in the operation of the crusher 70. The adjustment is simple and is quickly performed. The adjusting ring 20 is simply advanced in a counterclockwise direction, in accordance with the described embodiment, until the feed tube 40 repositions itself by dropping from one level 28 to the next under the force of gravity. The adjusting ring 20 is then tapped in the opposite or clockwise direction as previously described to secure or lock in the new position of the carrier tube 25. It should be understood that the direction of moving the adjusting ring 20 is determined by the particular direction in which the levels or steps 28 are arranged about the carrier tube 25. A mirror image of the described adjustment elements with a corresponding reversal of the adjustment direction of the ring 20 as well as similar changes to achieve the described results are considered to be within the scope of the invention.

When the lower tube 45 is worn to its maximum adjustment limit, the adjusting lugs 23 at that time would rest against the underside of the upper flange 26 of the carrier tube 25. At that time the entire feed tube 40 may simply be lifted from the crusher 70 together with carrier tube 25. The upper tube 41 may provide for that purpose a pair of diametrically opposite lifting handles 74 by which the tube 40 or the upper tube portion 41 together with the carrier tube 25 may be conveniently handled. It is preferred to remove the hopper 16 from the lid throat flange 15 prior to lifting the feed tube 40 with the carrier tube 25. The worn remainder of the lower tube portion 45, with typically only a ring of material of and adjacent the rim 47 expected to be remaining, is removed from the upper tube portion 41 and is replaced with new lower portion 45 after removing the retainer bar 54 or all retainer bars 54 from the respective open recesses 48 (see FIG. 3). The rim 47 typically would also have received a certain amount of wear. However, because of the increased thickness of the rim or lip 47, the rim is expected to still remain in tact at the time of replacement of the lower tube 45, such that the lower end and the lugs 44 of the upper tube 41 remain protected at all times by the rim 47.

During the replacement of the lower tube 45, the feed tube 40 is supported as already referred to by the lifting handles. During the removal and re-installation of the tube 40 in accordance herewith, the carrier tube 25 remains preferably joined and in fixed relationship to the upper tube 41. To provide for such a combination, the carrier tube 25 may, of course, be bolted to the upper tube 41. However, the described structure provides for a space 76 (see FIG. 5) to become filled with rocks, dust and other debris during the initial operation of the adjustable feed tube assembly 39. The deposited materials have been found to securely attach the carrier tube 25 to the upper tube 41, such that the two tubes do in fact become a unitary element after initial operation for most practical purposes. It is, of course, possible to clear the referred to debris from such annular space 76 and separate the two tubes from each other. However, it has been found that the replacement of the lower tube 45 proceeds more expeditiously when the carrier tube 25 remains joined to the upper tube 41. In addition, the carrier tube 25 becoming fixedly attached to the upper tube 41 of the feed tube 40 in essence establishes a fixed relationship of the feed tube 40 to the crusher when the position of the carrier tube has been secured as described herein. It has been found that when the feed tube 40 is not securely disposed with respect to the crusher 40, pressure of materials fed through the feed tube 40 to the crusher for processing tend to build between the impeller table 71 of the crusher 70 and the lowermost end of the feed tube 40 and tend to raise the feed tube upward from the crusher, ultimately requiring a shutdown of the crushing operation.

It should be noted that it may also be possible to replace the lower tube portion 45, as herein described, without removing and replacing the hopper 16. However, with the hopper 16 removed, the described elements are more accessible. Consequently, for convenience it is preferred to remove the hopper 16 and clear remaining debris and rocks from the hopper 16. The adjusting ring 20 is then returned to its "start" position. Upon attachment of a new, hence, a replacement lower tube 45 to the upper tube 41, the carrier tube 25 and feed tube 40 are again installed to the uppermost position of the feed tube assembly 39 above the described adjustment steps 28. The initial adjustment and securing of the tube 40 in such initially adjusted position proceeds, all as previously described.

Other changes and modification within the scope of the invention may be made with respect to moving the adjusting ring 20, for example. It may be possible, for example, to widen the adjusting ring 20 and provide the ring 20 with long, circumferential slots (not shown) which lie on the bolt circle of the holes 52 to permit the ring to rotate with respect to at least some of the bolts 50. Such an embodiment, however, is at the present not preferred. Another change or modification of the adjusting ring 20 may be made with respect to rotationally advancing the ring 20. Instead of providing the ring 20 with the two opposite outer tabs 21, the radially outward directed edge of the adjusting ring 20 may be serrated or equipped with gears. The adjacent lid throat flange 15 and hopper throat flange 18 may then be spaced by a non-continuous spacer (not shown) which is, except for a gap, essentially circular like the flanges 15 and 18 and includes the matching holes 52 to be mounted between the two flanges. The gap in such spacer would allow access to the adjusting ring 20, such that the geared outer surface of the ring 20 may be turned for the above-described adjustment of the feed tube 40 using a tool which engages the gears. Such gears may further be used to lock the rotated position of the adjusting ring 20 as further described herein.

It should, consequently, be realized that various other changes and modifications are possible without departure from the scope and spirit of the invention, though the invention has been described in terms of a particular embodiment, being the best mode known of carrying out the invention. Rather, the invention is not intended to be limited to the described embodiment alone. Instead the following claims are to be read as encompassing all adaptations and modifications within the spirit and scope of the invention.

What is claimed is:

1. In a vertical shaft impact crusher having a housing including an upper lid, an impeller table disposed within the housing to rotate about a vertical, central crusher axis, means, disposed above the impeller table, for receiving materials to be crushed, throat means disposed between the materials receiving means and the upper lid, and a feed tube disposed within the throat means, the feed tube communicating between the material receiving means and the impeller table for feeding materials from the materials receiving means to the impeller table, the improvement comprising:

the throat means of the crusher including a lid throat and a hopper throat, the respective lid and hopper throats being coextensive with respect to each other and coaxialy aligned with the central crusher axis;

an adjusting ring disposed concentrically between the lid throat and the hopper throat, the adjusting ring including a plurality of circumferentially spaced adjusting lugs extending radially inward toward the feed tube;

a plurality of circumferentially spaced sets of incremental steps fixedly disposed corresponding to the circumferentially spaced adjusting lugs with respect to the feed tube and peripherally disposed about the feed tube, adjacent steps in each set of steps being circumferentially displaced with respect to each other and having a vertical drop of a predetermined adjustment distance, the adjusting lugs being disposed to extend radially into engagement with respective ones of the steps, the rotational disposition of the adjusting rim about the crusher axis determining the corresponding step of each set of steps being engaged by the lugs of the adjusting ring for determining the height of the adjusting tube with respect to the impeller table;

means for rotating the ring circumferentially about the central crusher axis to a predetermined circumferential position; and means for restraining further movement of the feed tube in the vertical direction relative to the impeller table subsequent to an adjustment of the feed tube by one of said incremental steps, thereby positioning a lowermost end of the feed tube at a desired height above the impeller table for regulating the material flow to the crusher.

2. The crusher according to claim 1, wherein the steps in each set of steps are disposed in a counterclockwise ascending order, whereby the feed tube is incrementally lowered in response to a counterclockwise rotation of the adjusting ring.

3. The crusher according to claim 2, wherein the means for rotating the ring circumferentially comprises radially outwardly directed tabs attached to the outer periphery of the ring and extending radially outward from the lid and hopper throats.

4. The crusher according to claim 3, wherein the means for restraining further movement of the feed tube comprises an undercut at an inner edge of each step, and a corresponding seating end for engaging the undercut, the seating end disposed at the clockwise facing edge of the respective lugs, thereby enabling the lugs to seatingly engage the respective undercuts at each of the steps in response to a clockwise movement of the adjustment ring.

5. A vertical shaft impact crusher, the crusher including a housing, a rotor mounted for rotation about a vertical axis and having a horizontally disposed upper impeller surface, a material feed hopper disposed vertically above and coaxially aligned with a central axis of the rotor, and a vertically adjustable feed tube assembly disposed concentrically with the central axis of the rotor above the impeller surface of the rotor, wherein the improvement comprises:

a two-portion feed tube having an upper, reusable tube portion and a lower, expendable tube portion, the upper tube portion having upper and lower ends and the lower tube portion having upper and lower ends, means disposed adjacent the lower end of the upper tube portion for engaging the upper end of the lower tube portion and for temporarily joining the lower tube portion to the upper tube portion;

a carrier means disposed about and vertically supporting the upper tube portion, the carrier means including a plurality of stepped support ledges disposed at predetermined vertical distances with respect to each other;

an adjusting ring supported by the crusher, the adjusting ring having adjusting lugs for engaging selected ones of the stepped support ledges and thereby for vertically positioning the feed tube with respect to the impeller surface in a selected one of a plurality of vertically predefined steps; and means for locking the vertically positioned feed tube in the selected one of the plurality of vertically predefined steps.

6. The crusher according to claim 5, wherein the lower tube portion comprises means disposed at the upper end of the lower tube portion for protecting the engaging means of the upper tube portion.

7. The crusher according to claim 5, wherein the means for locking the vertically positioned feed tube in the selected one of the plurality of vertically predefined steps comprises an undercut associated with each of the steps, the adjusting lugs of the adjusting ring being complementary to the undercut configuration of the respective step for becoming seated therein and preventing further vertical movement of the feed tube carrier with respect to the crusher.

8. The crusher according to claim 5, wherein the lower tube portion engaging means disposed adjacent the lower end of the upper tube portion comprises peripherally spaced radially outward directed lugs, and the upper end of the lower tube portion includes complementary recesses for receiving the lugs, the recesses including rotationally displaced axially closed recess portions to removably attach the lower tube portion to the upper tube portion in response to a coaxial twist of the lower tube portion with respect to the upper tube portion, the feed tube assembly further including means for temporarily looking the lower tube portion in an attached axially twisted orientation with respect to the upper tube portion.

9. The crusher according to claim 8, the lower tube portion comprising a rim portion disposed about the upper end thereof, the rim portion receiving the outward directed lugs adjacent the lower end of the upper tube portion and having a material thickness for protecting said lugs from wear during the attachment of the lower tube portion to the upper tube portion.

10. The crusher according to claim 5, wherein the carrier means comprises a carrier of the feed tube disposed about the feed tube and including means for vertically supporting the upper tube portion, the carrier supporting peripherally spaced sets of the stepped support ledges on an outer surface thereof, the lugs of the adjusting ring being disposed radially inward for engaging the selected ones of the stepped support ledges, thereby positioning the carrier and the feed tube with respect to the impeller surface of the rotor of the crusher.

11. The crusher according to claim 10, wherein a lower end of the hopper comprises a cylindrical hopper throat having a lower flange, and the crusher comprises a lid having an upward directed lid throat and a flange attached to an upper end thereof, and wherein the adjusting ring is disposed between the lid throat flange and the hopper throat flange, the lid throat flange and the hopper throat flange comprising means selectively releasable for tightening the adjusting ring between said flanges and restraining the adjusting ring from rotation.

12. The crusher according to claim 11, further comprising means disposed within the lid throat for restraining the carrier from rotational movement with respect to the crusher.

13. The crusher according to claim 12, wherein the lid throat includes means for locating the adjusting ring with respect to a first set of the steps.

* * * * *